US005234218A

United States Patent [19]

LaRocca

[11] Patent Number: 5,234,218

[45] Date of Patent: Aug. 10, 1993

[54] DICE GOLF GAME

[75] Inventor: Richard V. LaRocca, 130 West Dr., North Massapequa, N.Y. 11758

[73] Assignees: Richard LaRocca, N. Massapequa, N.Y.; Ronald LaRocca, Ringwood, N.J.

[21] Appl. No.: 994,506

[22] Filed: Dec. 21, 1992

[51] Int. Cl.[5] ..... A63F 3/00

[52] U.S. Cl. ..... 273/245

[58] Field of Search ..... 273/245, 146

[56] References Cited

U.S. PATENT DOCUMENTS 3,826,498 7/1974 Monek ..... 273/245

*Primary Examiner*—Benjamin H. Layno

*Attorney, Agent, or Firm*—Galgano & Belkin

[57] ABSTRACT

A dice golf game having five dice wherein the dice represent various golf clubs and a roll of the die or dice determines the advancement of the ball. Specifically, five dice represent a driver, four a wood, three an iron, two a wedge and one a putter. Each die has six sides with three sides having a representation of a golf ball, two sides being blank and one side having a representation of a sand trap. Charts for tee shots, approach shots and putt shots have indicia corresponding to a roll of the die or dice for determining the advancement of a ball on each hole. The chart for tee shots include use of a driver, a wood and an iron. The chart for approach shots include use of a wood, an iron, and a wedge and the chart for putt shots include use of a putter.

9 Claims, 3 Drawing Sheets

DICE GOLF GAME

BACKGROUND OF THE INVENTION

The present invention relates generally to a dice game. More particularly, this invention relates to a dice game for simulating the playing of golf.

A number of golf games have been devised which attempt to simulate the real game of golf. Generally, these simulated games involve a board or number of boards representing the holes of a golf course which include a tee, fairway, obstacles and a green. Advancement of the golf ball is accomplished by a first and second chance means for determining the direction and the distance of travel.

For example, U.S. Pat. No. 5,000,460, granted to Barbiaux et al, includes a board wherein the advancement of the ball is determined by a direction indicating gauge and a roll of a die corresponding to the various directions on the gauge. The distance of the ball is determined by another roll of the dice for corresponding comparison to indicia on a chart. See also, U.S. Pat. No. 4,809,985, to Trimble, and U.S. Pat. No. 3,410,561, to Ekstrand.

Another example, U.S. Pat. No. 4,277,065, to White, includes a board having a grid layout which contains various obstacles between the tee and the green wherein the ball is moved along the board by choosing and rolling a directional die and rolling a distance die Similarly, U.S. Pat. No. 4,759,548, to Chaban, includes an annular golf course with an annular grid playing area with a partial overlay which varies the types of hole layouts Again, distance and direction is determined by rolling dice.

Another example, U.S. Pat. No. 4,113,260, to Sain, includes a board having fairway bar lines and a grid layout on the greens wherein the ball is moved along the board by a combination of a spin of the hazard, putt and green spinner card, use of skill card and roll of a number of dice.

A further example, U.S. Pat. No. 4,380,338, to Lacy, includes a board having the layout of the golf course, a first set of shot charts correlating various positional changes on a respective par 3, par 4 and par 5 holes to a roll of a single die. A second set of charts allows a player to alter his shot by a second roll of the die.

The closer a simulated game of golf tries to approach the characteristics of the real game, such as incorporating hazards or including penalties, the more complicated and time consuming the process of playing the simulated holes and game becomes A simulated golf game is needed which is small, compact, easy to play, not excessively time consuming yet capable of simulating the real game of golf. Since all golf course holes are generally the same containing a tee off area, fairway and a green from which to putt the game should allow the player or players to visualize the placement of the ball from one shot to the next.

There is also a dice golf game sold commercially under the trademark CASINO GOLF, which consists of three golf dice, each of which has six golf terms on its six faces—namely, "HOLE IN ONE," "EAGLE," "BIRDIE," "PAR," "BOGEY" and "DOUBLE BOGEY." A stack of betting chips and a betting layout board similar to the type used in Roulette, but with the above-noted golf terms in place of the Roulette numbers. The game is played by placing bets on the betting layout board; and when one player rolls all three dice at once and the three golfing terms on the top surface of the dice are the winners. As can be appreciated, aside from using dice with golf terms thereon, the game itself does not simulate the playing of golf.

There is also another dice golf game sold commercially under the trademark U.S.A. OPEN GOLF DICE which consists of five dice having the same six golf terms displayed on their respective six faces, as does the CASINO GOLF game discussed above, and with which several different games may be played. In each game, all five dice are rolled, and points are awarded depending on which golf terms are rolled. In a couple of the games, the dice are used to simulate a poker hand. In one game, the players try to roll certain dice face combinations in a predetermined number of rolls. However, here again, the game, while using the golf terminology, does not truly simulate the playing of golf.

SUMMARY OF THE INVENTION

Accordingly, it is an object of the present invention to provide an improved dice golf game which simulates the us of various golf clubs and shots used in playing the game of golf.

It is also an object of the present invention to provide such a dice golf game which is small and compact permitting play on any flat surface.

It is still another object of the present invention to provide such a dice golf game which is simple to understand and easy to play and wherein advancement of the ball can be easily visualized.

It is a more particular object of the present invention to provide such a novel golf dice game which is relatively inexpensive to manufacture and which can also utilize existing golf score cards for game play and scoring.

Certain of the foregoing and related objects are readily attained in a golf game which includes a multiplicity of dice corresponding in number to a predetermined par value of a golf hole to be played. The dice each have six sides with at least two and preferably three different representations on separate sides thereof. The game also includes three charts. A first chart represents possible tee shots for the golf hole to be played, identifies all of the possible roll combinations for a first roll of the dice and has indicia corresponding to each different rol combination for determining the advancement of a ball on each hole. A second chart represents possible approach shots from the fairway for the golf hole to be played, identifies all of the possible roll combinations of a subsequent roll of a predetermined subset of the dice and has indicia corresponding to each different roll combination dice for determining the further advancement of a ball on each hole. Finally, a third chart represents putt shots on the green of the hole to be played, identifies all of the possible roll combinations for a last roll of one die and has indicia corresponding to each different roll combination of the die for determining the number of putts of the ball to finish each hole.

Preferably, the game includes five dice to enable one to play golf holes having a par value up to par 5. Each of the dice has six sides with three sides having a first representation thereon, two sides having a second representation different from said first and one side having a third representation different from said first and said second sides. Most advantageously, the first side of the dice is a representation of a golf ball, the second side is a blank face, and the third side is a representation of a sand trap. When playing the game, five of the dice are rolled to represent a driver, four of the dice represent a wood, three of the dice represent an iron, two of the dice represent a wedge and one die represents a putter. The first chart includes tee shots for a driver, a wood and an iron, and the second chart includes approach shots for a wood, an iron, and a wedge.

Most desirably, the golf game also includes a score card having a first row for identifying the par value for each hole to be played and which has additional rows underneath the first row for listing the scores for each player for each hole played.

Certain of the foregoing and related objects are also attained in a method of playing a golf game which includes the steps of determining a par value for a hole, and rolling a number of dice corresponding in number to the par value of the hole and which roll also represents a tee shot to produce a first roll combination. The first roll combination is then compared to a first chart representing possible tee shots for the golf hole to be played which identifies all of the possible roll combinations for a first roll of the dice and which has indicia corresponding to each different roll combination for determining at least the first of a number of strokes for completing the hole and the advancement of a ball on the hole.

If the player does not "hole out" or complete the hole on the first roll, the player then rolls a lesser number of dice than the first roll which may represent an approach shot to produce a second roll combination for further advancement of the ball. The second roll combination is then compared to a second chart representing possible approach shots for the golf hole to be played which identifies all of the possible roll combinations for a subsequent roll of the dice and which has indicia corresponding to each different roll combination for determining at least the second of a number of strokes for completing the hole and a further advancement of a ball on the hole.

If a player does not "hole out" on the first roll, the player, upon reaching the green following the tee shot or one or more approach shots, will roll one die which represents a putt. The representation on the die is then compared to a third chart representing possible putt shots for the golf hole to be played which identifies all of the possible roll combinations for the last roll of the die and has indicia corresponding to each different roll combination for determining the final number of strokes for the hole.

Most desirably, the method also includes the step of totaling the number of strokes for each player for each hole played and entering the same in a golf score card.

BRIEF DESCRIPTION OF THE DRAWINGS

Other objects and features of the present invention will become apparent from the detailed description considered in connection with the accompanying drawings, which disclose several embodiments of the invention. It is to be understood that the drawings are to be used for the purpose of illustration only and not as a definition of the limits of the invention.

In the drawings, wherein similar reference characters denote similar elements throughout the several views.

DETAILED DESCRIPTION OF THE PREFERRED EMBODIMENTS

Turning now in detail to the drawings, therein illustrated is a dice golf game including five dice 10, three shot charts 30, 40, and 50 and a score card 60 or 70 embodying the present invention. The dice 10 are used to represent the various golf clubs used in playing the conventional game of golf. Specifically, all five dice are used to represent a driver, four dice are used to represent a wood, three dice are used to represent an iron, two dice are used to represent a wedge and one die is used to represent a putter. In addition to dice 10 representing the various types of golf clubs, a roll or throw of the die or dice determines the advancement of the ball for each golf hole as identified on charts 30, 40 and 50.

Figure 1:
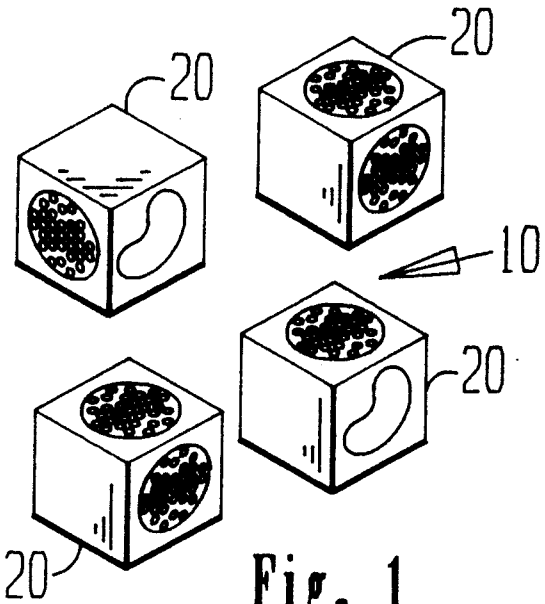
FIG. 1 is a perspective view of the dice used in the novel dice golf game embodying the present invention.
Figure 2:
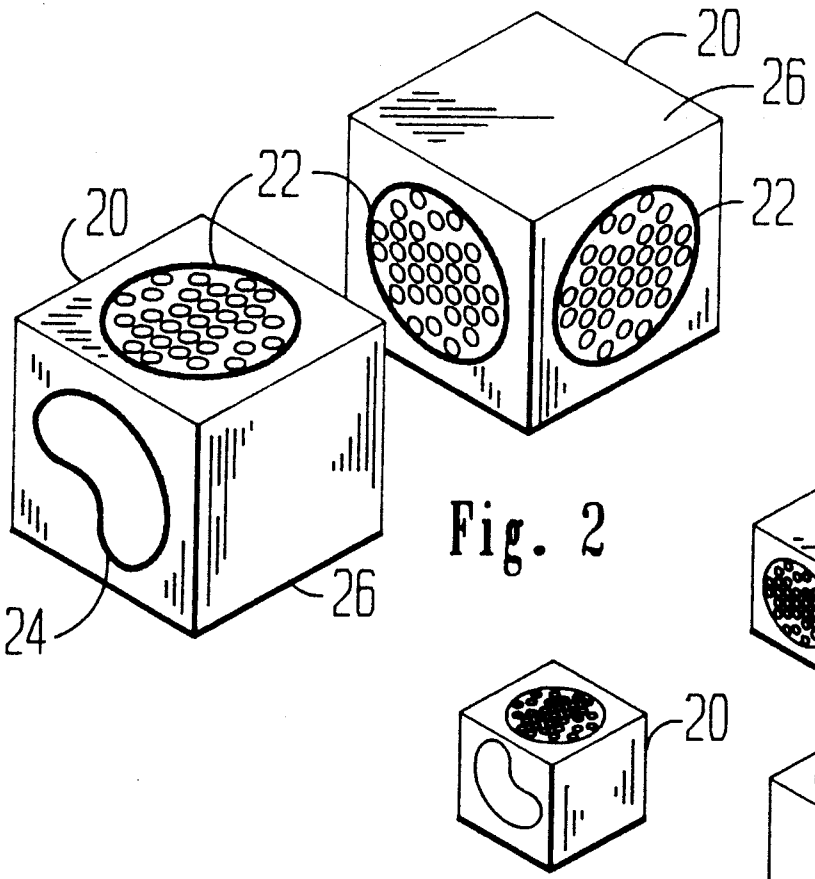
FIG. 2 is an enlarged perspective view of two of the dice shown in FIG. 1, but with their faces arranged to show the six sides of each die.

With reference to FIG. 2, a pair of dice 20 is shown displaying the different representations covering all six sides of each of die 20. Specifically, three sides contain a representation of a golf ball 22, one side contains a representation of a sand trap 24, and the remaining two sides contain a blank or blank face 26. Thus, for each die 20 the odds are three out of six for ball 22 two out of six for blank 26 and one out of six for trap 24.

Figure 6:
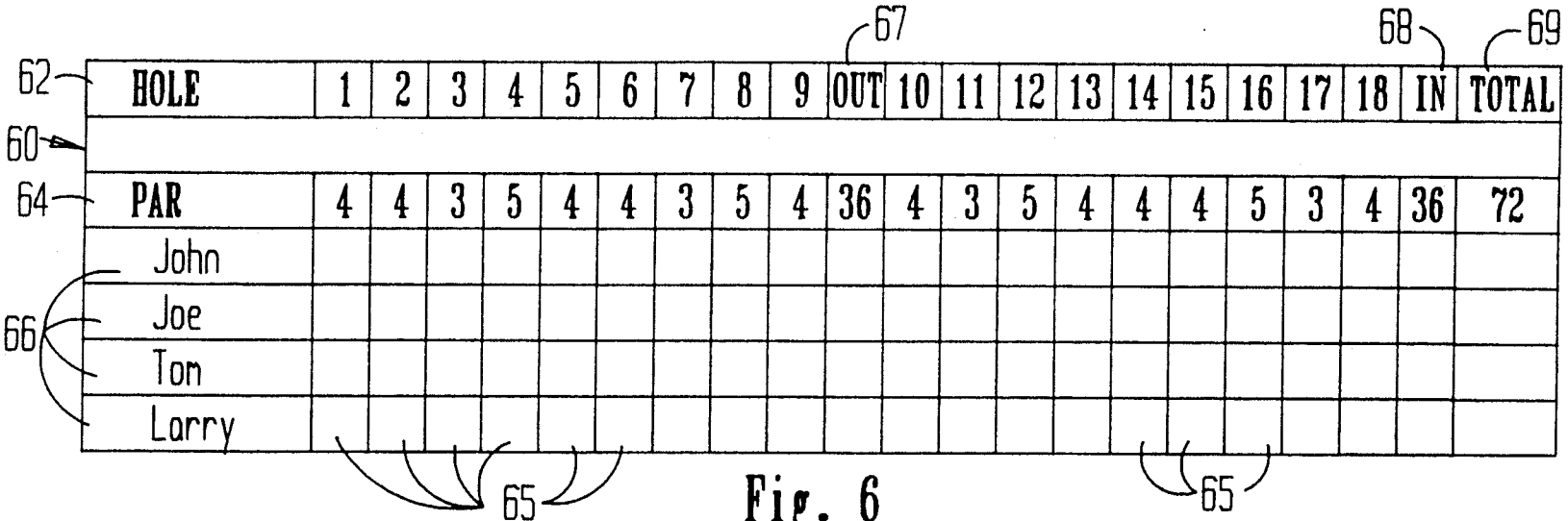
FIG. 6 is a plan view of a score card used in scoring the game.

The dice golf game, as in the play of golf on a regulation golf course, includes a multiplicity of par 3, par 4, and par 5 holes comprising either a 9 hole or 18 hole course. A typical scoring card 60, which simulates a conventional scoring card, is displayed in FIG. 6, and generally includes a top line numerical listing 62 labeled "HOLE" of the golf holes to be played, beneath which is a "PAR VALUE" row or line 64 labeled "PAR," which identifies the corresponding par value for each hole. Beneath the par value line 64 are rows or spaces 66 for listing the players names. The successive columns of empty spaces 65 beneath the "PAR VALUE" line 64 is used for entering each players' scores for each hole as one would in scoring a conventional game of golf. The score card 60 also has two subtotal columns 67, 68 for the first and second nine holes labeled "OUT," and "IN", respectively, as well as a "TOTAL" column 69 for adding the players' total scores.

Alternatively, players can use scoring cards from local or nationally known golf courses. Players can even create their own golf course, generally totaling an overall par of 36 for each 9 holes of play. Each hole of golf begins with a tee shot followed by the possibility of approach shots from the fairway and/or putts on the green.

Figure 3:
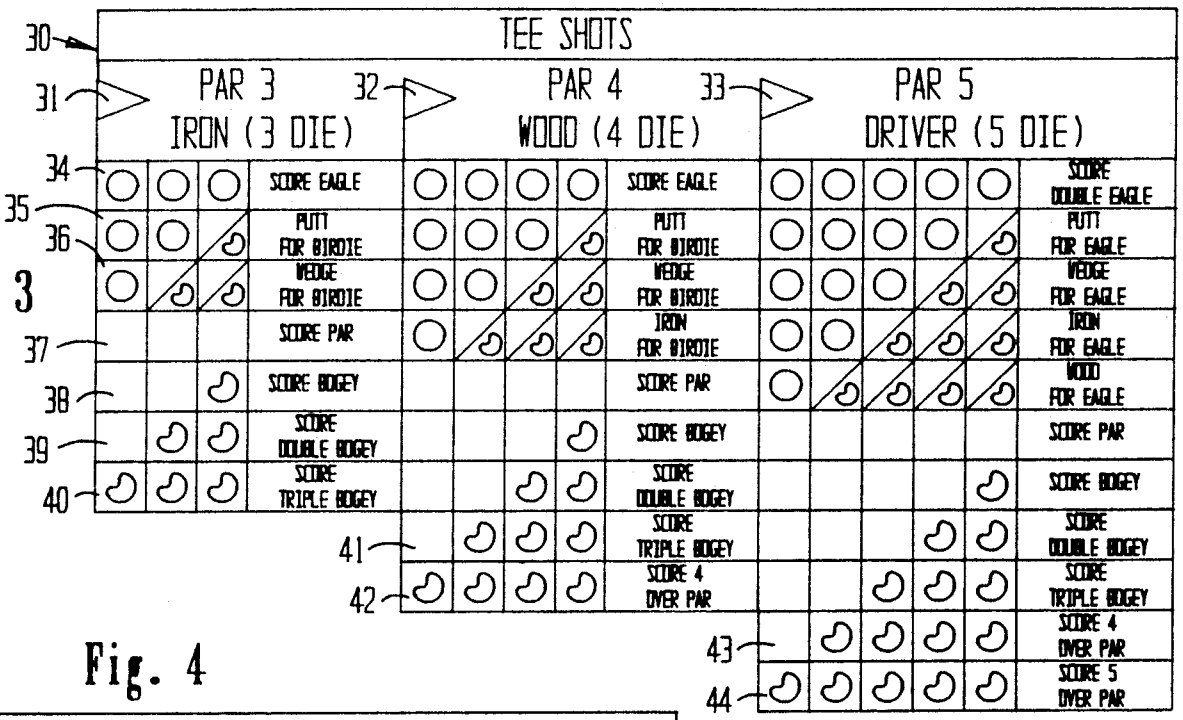
FIG. 3 is a chart for the scoring of "tee shots" depending on the par value of the hole played, and for determining the manner of further play and the advancement of a ball on each hole.

In the play of the dice golf game, the advancement of the ball from the tee to the pin or hole, utilizes dice 10 and charts 30, 40 and 50. Referring to FIG. 3, chart 30 labeled "TEE SHOTS" describes the tee shots for beginning each hole. Chart 30 is divided into three columns 31, 32, and 33 which correspond to a par 3 hole, par 4 hole and a par 5 hole respectively Each column lists the number of dice to be initially rolled corresponding to the first club that would normally be used on a golf course for such a par value Thus, referring to "PAR 3", column 31, for a par 3 hole, which normally has the shortest distance, one would utilize an iron, or three dice. Likewise, under "PAR 4", column 32, for a par 4, which normally has an intermediate distance, one would use a wood, or four dice. Under "PAR 5", column 33, for a par 5 which normally is the longest hole on a golf course, one would utilize a driver, which is five dice.

Columns 31, 32 and 33 also list the various indicia of all possible combinations of a roll of the dice for corresponding advancement of the ball for a par 3, par 4 and par 5 hole, respectively. For example, chart 30, column 31, line 34, shows the combination of three balls 22 which results in the score of an eagle (a hole in one on a par 3), and the hole is finished. The player would then mark his score card for the par 3 hole with a "1." Similarly, if the player rolls the dice combination shown in lines 37, 38, 39, 40, he also automatically finishes the hole with the score listed at the end of the respective line for that column, i.e., "SCORE PAR," or 3 for a par 3; "SCORE BOGEY," or 4 for a par 3; "SCORE DOUBLE BOGEY," or 5 for a par 3; and "SCORE TRIPLE BOGEY," or 6 for a par 3. Other combinations of a roll do not complete the hole but require at least an additional roll of a lesser number of the dice. For example, chart 30, column 14, line 35, shows two balls 22 and either blank 26 or trap 24, on the remaining die, resulting in the requirement of taking a "PUTT FOR BIRDIE," and line 36 shows one ball 22 and either blank 26 or trap 24, on either of the other two dice, requiring a "WEDGE FOR BIRDIE," which will be discussed in greater detail hereinafter.

When playing a par 4 hole, one would roll four dice and then look at the possible dice combinations under column 32, lines 34–42. Lines 34 and 38–42 provide for an automatic score—namely, "SCORE EAGLE" (a "2" for a par 4), "SCORE PAR" (a "4" for a par 4), "SCORE BOGEY" (a "5" for a par 4), "SCORE DOUBLE BOGEY" (a "6" for a par 4), "SCORE TRIPLE BOGEY" (a "7" for a par 4) and "SCORE 4 OVER PAR" (an "8" for a par 4), respectively. Here again, the player would mark his score card for the par 4 hole with the numerical score he achieved. Alternatively, the player could roll combinations shown on either of lines 35, 36 or 37 under column 32 and be required to "PUTT FOR BIRDIE," "WEDGE FOR BIRDIE" or "IRON FOR BIRDIE," as discussed in greater detail below.

Finally, when playing a par 5 hole, the player would roll five dice (corresponding to a driver and then look for the dice combination thrown under column 33, line 34–44. Once again, rolling one of the dice combinations shown on lines 34, 39–44 results in an automatic score for the hole—namely, "SCORE DOUBLE EAGLE" (a "2" for a par 5). "SCORE PAR" (a "5" for a par 5), "SCORE BOGEY" (a "6" for a par 5), "SCORE DOUBLE BOGEY" (a "7" for a par 5), "SCORE TRIPLE BOGEY" (an "8" for a par 5), "SCORE 4 OVER PAR" (a "9" for a par 5) and "SCORE 5 OVER PAR" (a "10" for a par 5), respectively. Once again, the player would mark the score achieved on his score card 60 under the appropriate par 5 hold designation. Alternatively, the player could roll the dice combination shown on one of lines 35, 36, 37 38 and be required to "PUTT FOR EAGLE," "WEDGE FOR EAGLE," "IRON FOR EAGLE" and "WOOD FOR EAGLE," as discussed below.

Figure 4:
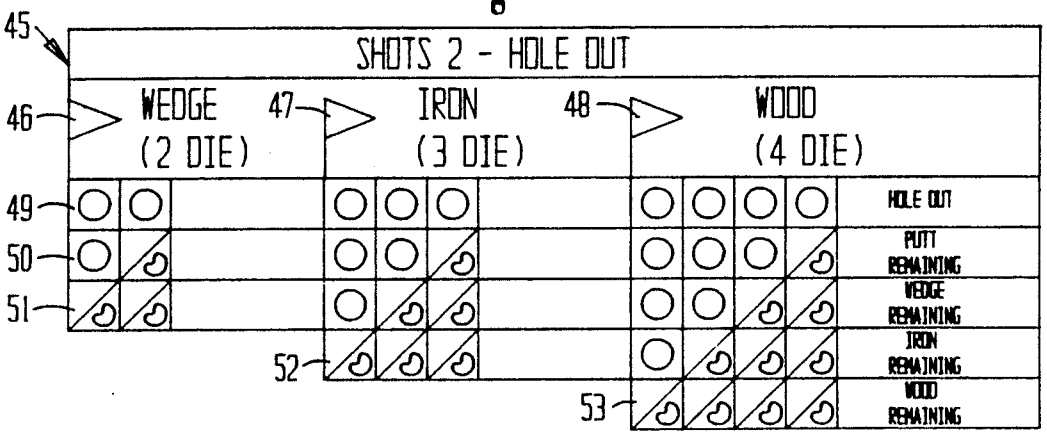
FIG. 4 is a chart for the scoring of "approach shots" and for determining the manner of further play and advancement of a ball on each hole.

Fairway approach shots may be necessary for reaching the green or completing a hole after teeing off, which requires the player to roll two o more dice again. Referring to FIG. 4, fairway and approach shots are shown in chart 45 labeled "SHOTS 2-HOLE OUT" which is divided into three columns 46, 47, 48, labeled "WEDGE", "IRON" and "WOOD", respectively. Each column lists the number of dice which represents the club utilized in the fairway or approach shot. Thus, referring to column 46, a wedge shot utilizes two dice. Likewise, column 47 utilizes an iron shot which is three dice and column 48 utilizes a wood shot which is four dice.

If, for example, a player having initially rolled the dice and obtained for a par 3 or par 4 "WEDGE FOR BIRDIE" (line 36) or for a par 5, "WEDGE FOR EAGLE", (line 36) the player would roll 2 dice and look to chart 45 (FIG. 4) for the combination rolled under column 46, lines 49–51. If he rolled two balls 22, he would "HOLE OUT" (line 51) which would mean he would score a BIRDIE for either the par 3 or 4 hole (a "2" for a par 3 and a "3" for a par 4 score) or an EAGLE (a "3") for the par 5. If the player rolled a ball 22 and either a sand trap 24 or a blank 26 (line 50), the player would have a "PUTT REMAINING," which would mean he missed the shot for birdie or eagle and would be now putting for par (for the par 3 or par 4) or a birdie (for the par 5), as per chart 55, as described hereinafter. If the player were to roll a combination of blanks 26 or sand traps 24 (line 51), the player would still have a "WEDGE REMAINING," which would mean not only did he miss the birdie (OR EAGLE) shot, but he also missed the green, requiring him to take another wedge shot and costing the player another stroke or point; each roll of the die or dice being equivalent to a golf stroke or another point unless otherwise indicated on the appropriate chart 30, 45, 55.

Alternatively, if the player on his tee shot playing either a par 4 or par 5 hole rolled the combination illustrated for line 37 of chart 30 "IRON FOR BIRDIE" or "IRON FOR EAGLE", respectively, he would then roll either three dice (for par 4) or four dice (for par 5) and look for the combination rolled under column 47 or column 48 of chart 45. If the player rolled either three or four golf balls 22, respectively, (line 49), the player would "HOLE OUT" or score the BIRDIE (one under par) or EAGLE (two under par). If the player rolled the combination shown at line 50 under column 47 he would have a "PUTT REMAINING" which would mean that he would be putting for either par or for birdie (depending upon whether it was a par 4 or par 5) as described in greater detail hereinafter. If, however, the player rolled the combination shown at line 51 of column 47, he would then have a "WEDGE REMAINING" and would follow the chart 45 according to column 46 requiring at least one additional point or stroke. Alternatively, if the player were to roll either of the combinations shown at line 52 of column 47 or 48, the player would have a "IRON REMAINING" and would then have to roll three dice and repeat the play as described above for an iron shot.

Finally, if the player was playing a par 5 hole and initially rolled the combination at line 38 of chart 30, the player would then be shooting a "WOOD FOR EAGLE" or rolling four dice and would score the same according to column 48 of chart 45. Here, again, if the player rolled all four golf balls 22, he would hole out or score an eagle (a "3") for the hole or he could possibly roll the other combinations discussed above or the combination shown at line 53 which would consist of a combination of blanks and/or sand traps which would result in the player scoring another stroke and having a "WOOD REMAINING" which would mean he would have to roll four dice again for an additional wood shot.

In each of the previous charts where a putt is indicated (i.e., PUTT FOR BIRDIE, PUTT FOR EAGLE and PUTT REMAINING), the player would then be considered to be on the golf green and ready to putt for the hole. Once on the green, a putt shot involves the roll of a single die. Putt shots are described in chart 55 shown in FIG. 5 having lines or rows 56, 57 and 58 corresponding to the three different roll possibilities. As shown in row 56, a roll of ball 22 results in a successful putt for one stroke. A roll of blank 26 results in a missed putt with an automatic tap in, thus two putts or strokes. A roll of trap 24 results in two missed putts together with an automatic tap in for a total of three putts or strokes to finish the hole off.

The charts 30, 45, 55 are representatively designed to correspond to the different probabilities of reaching the pin on par 3, par 4, par 5 holes on regulation golf courses. The charts may be displayed on one card or on three separate cards.

Figure 7:
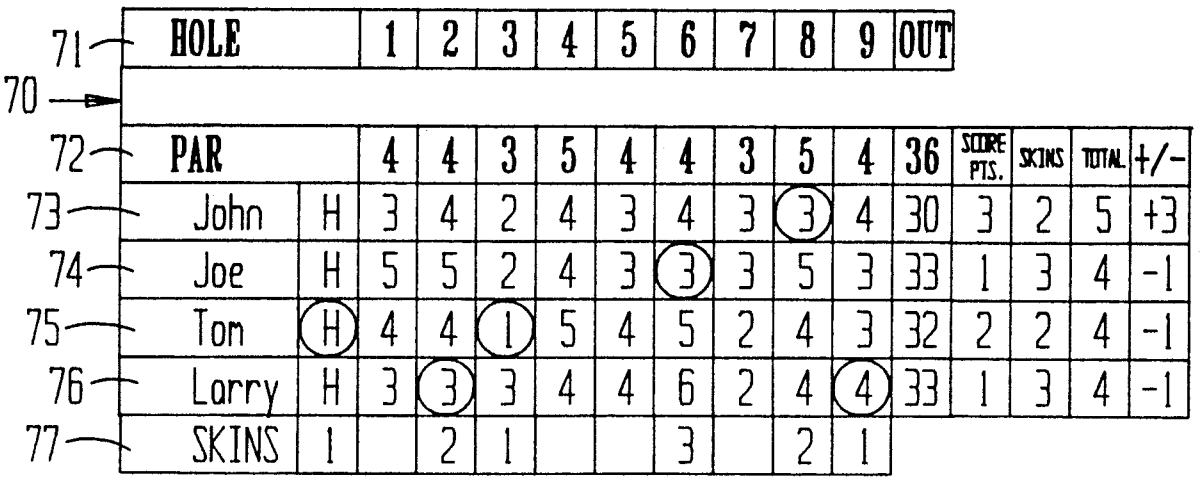
FIG. 7 is a plan view of a completed nine hole game score card according to an alternate embodiment of the invention which is adapted for betting purposes.

FIG. 7 is an example of an alternate embodiment of the score card 70 which can be used for wagering, where permitted. The score card 70 includes a top line or row labeled "HOLE" designating the hole being played, i.e., HOLES 1–9, and at the end of the row, the last column is labeled "OUT" which is used for totaling the players, scores. A second row 72 entitled "PAR" spaced below the hole line 71 identifies the par values for each hole played and the total par for the nine holes played under the "OUT" column. There are four additional columns after 36 on par line 72 entitled "SCORE POINTS", "SKINS", "TOTAL" and "+/−", the purpose of which will be discussed in greater detail hereinafter. There are four additional rows or lines under the par line for each of the four players—namely, lines 73, 74, 75, 76 for keeping their score, and a last line entitled "SKINS", the purpose of which will be discussed in greater detail hereinafter. Lines 73–77 also have an initial column with a "H" designation in each line, the purpose of which will also be described in greater detail hereinafter.

EXEMPLARY RULES OF PLAY

The dice golf game can be played by either one player or a number of players. With more than one player the players determine the order for teeing off on the first hole. The order may be determined among the players themselves, by a flip of a coin, or a roll of five dice with the player receiving the greatest number of golf balls showing going first, the player with the second greatest number going second and so on. The players names are placed on lines 66 of the scoring card 60 supplied with the game (FIG. 6), a scoring card from a local or national regulation golf course, or a scoring card 70 (FIG. 7) generally having 36 par for 9 holes or 72 par for 18 holes. The players can change the order of play for the following holes based on such factors as who received the lowest score on the last hole or who has the overall lowest score up to the last hole.

The object of the dice golf game is to achieve the lowest score among the players over either 9 or 18 holes. If a player is playing alone he should set a goal of achieving under 36 strokes in completing 9 holes or 72 strokes in completing 18 holes.

The game begins with hole 1 and proceeds sequentially to hole 9 or hole 18. In describing the rules of play, a par 4 hole will be addressed, since a description of playing either a par 3 or par 5 hole is essentially the same.

To start the game as well as begin each hole, each player begins with a tee shot. For example, referring to FIG. 6, hole 1 is a par four hole. As shown in FIG. 3, chart 30, column 32, a par 4 hole uses a wood to tee off which is a roll, all at once, of four dice. The resulting combination displayed in the roll of the four dice determines the advancement of the ball. The combination obtained is compared to the nine choices shown in column 32, lines 34–42. Depending on the success of the roll a player's score for that hole may be determined and the hole completed, or the player is required to roll a number of dice at least one more time in order to finish out the hole.

A tee shot on a par 4 hole requires a roll of four dice. If four balls 26 are displayed (line 34), the result is a score of an eagle, two strokes under par. The hole is finished and the next player goes.

Figure 5:
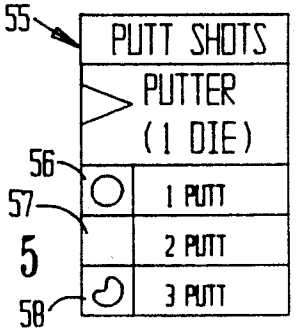
FIG. 5 is a chart for the scoring of "putt shots" and for determining the number of putts on each hole.

Tee shots displaying the following combinations with a roll of the four die having at least one ball showing (lines 35–37) requires at least one additional roll of a lesser number of dice for finishing out the hole. A roll of three balls 22 and either a blank 26 or trap 24 (line 35) advances the ball to the green and if followed by a successful putt a score of a birdie, one stroke under par. The player putts by rolling one die, as shown in FIG. 5. If a ball 22 is rolled (line 56), the putt is sunk and the player receives the score of a birdie. If a blank 26 is rolled (line 57), the player just misses the putt but automatically gets a short tap in, thus resulting in taking two strokes to sink the putt and scoring a par. A roll of a trap 24 would result in a three putt (line 58) to finish out the hole.

A roll of the dice displaying the combination of two balls 22 and either blanks 26 or traps 24 shown in the other two dice (line 36), sets up a "WEDGE FOR A BIRDIE". As shown in FIG. 4, column 46, a wedge requires the roll of two dice. A roll of two balls 22 (line 49) results in a "HOLE OUT" or a score of a birdie, one under par, for the hole. A roll of a ball 22 and either a blank 26 or trap 24 (line 50) results in a missed birdie with a putt remaining and if successful a score of par. A roll of each die showing a blank 26 or trap 24 (line 51) results in a missed birdie with now a "WEDGE REMAINING" and, if successful, for par.

An initial throw of the four dice resulting in only one ball 22 and blanks 26 or traps 24 (chart 30, line 37) sets up an "IRON FOR BIRDIE". As shown in FIG. 4, column 47, an iron requires the roll of three dice. A roll of three balls (line 49) results in a hole out or a score of a birdie, one under par, for the hole. A roll of two balls 22 and either a blank 26 or trap 24 (line 50) results in a missed birdie with a putt remaining and if successful a score of par. A roll of one ball 22 and a blank 26 or trap 24 displayed in the other two dice (line 51) results in a missed birdie with now a "WEDGE REMAINING" and, if successful, a score of par. A roll of blanks 26 or traps 24 displayed by the three dice (line 52) results in a missed birdie with now an "IRON REMAINING" and, if successful, a score of par.

For a tee shot on a par 4 hole with the following possible combinations displayed, the hole is completed, no further rolls of the dice are required. A roll of four blanks 26 (line 38) receives score of par. A roll of three blanks 26 and a trap 24 (line 39) yields a score of bogey, one over par. A roll of two blanks 24 and two traps 26 (line 40) yields a score of double bogey, two over par. A roll of three traps 26 and one blank 24 (line 41) is a triple bogey, three over par. The combination of four traps 26 (line 42) is a score 4 over par.

After the first player has completed the scoring for the hole the next player tees off and finishes out the hole. The players repeat this for each hole listing their score under the appropriate column in score card 60. A subtotal of their scores would be provided under column 67 labeled "OUT" for the first nine holes and under column 68 labeled "IN" for the second nine holes, and their total score would be listed in column 69 in comparison to the par 72 for the total of 18 holes.

Alternatively, the players could play a so-called "SKINS" version of the game (FIG. 7) wherein the low score on each hole wins a skin or point. To start, each of the players would putt for honors to determine who would go first. Each player would putt or roll a die, and the first player to make the putt (score a golf ball 22) would receive the honors, circle the "H" adjacent to his name (shown at line 75 for Tom in chart 70), and receive a skin or a point for obtaining the honor to go first. If there is a tie, the players tied would roll again to see who could score the golf ball 22 first.

The players would then play the game as previously described for hole number 1 and place their scores next to their names under the appropriate hole. In addition, the person with the lowest score for the hole would score a skin, and his score would be circled and a point awarded to that player which would be listed on the skins line 77. However, in the example shown in FIG. 7, in the first hole, both John and Larry tied with three strokes or a birdie for the par 4. In the case of a tie, no skins are awarded for that hole, but the skin point is carried over to the next hole and the lowest score in the next hole would then win two skins. As shown in FIG. 7, under hole number 2, line 76, Larry scored a birdie on hole number 2 which was the lowest score of the four players. His score is therefore circled, and he receives two skins indicated on line 77. In the example shown for hole number 3, Tom scores an eagle which is the lowest score, and his score is circled (line 75) and he is awarded one skin. However, for holes 4 and 5, several of the players have tied for low score, as a result of which no skins are awarded. They are, instead, accumulated for the next hole which in this case is hole number 6. In this example, Joe has scored a birdie for the par 4 of hole number 6 which is the lowest score and he therefore receives a total of three skins or points. For hole number 7, there was, again, a tie between Tom and Larry and therefore no skins are awarded. However, in hole number 8, John scores a birdie on the par three which is the lowest score, and he therefore receives two skins. On hole number 9, the last hole, the example shows a tie between Joe and Tom. Since this is the last hole, there is a "PUTT OFF" to determine who gets the point, and if there is a tie, all of the players ca putt again until only one player is successful in making the putt.

Under the "OUT" column, the players add up their scores and they are then awarded score points depending upon their standings. The low score is worth three points, the second lowest score is worth two points, the third lowest score is worth one point, and the fourth lowest score is worth no points. If there is a tie, for example, for low score, each player would be awarded three points, and similarly for a tie for the second lowest or third lowest score, each player would get either two or one points, respectively. Under the column entitled "SKINS", each player would add up the skins that they won during the course of the match, and then under total, their total score of score points and skins would be added together. Then in the +/− column, the total difference between each of the players would be scored. For example, since John had a total of five points and there was a one point difference with each of the three other players, he would have a total score of plus 3. Since Joe was even with Tom and Larry, the only difference was between him and John so that there would be a difference of −1. The same would apply to Tom and Larry.

Various modifications may be made to the invention as will be apparent to those skilled in the art. For example, the dice could have a number of other differing golf representations including other symbols, numbers or letters. In addition, the number of faces of the die assigned to a particular designation could be changed to change the odds of rolling a particular combination. In addition, the scoring for rolling various combinations ca also be modified to suit the particular game application. In addition, the dice could be represented by an electronic game apparatus such as the hand-held computer games which could determine the roll of the die and even possibly display the movement of the golf ball along a course on a screen.

Thus, while only several embodiments of the present invention have been shown and described, it is obvious that many changes and modification may be made thereunto without departing from the spirit and scope of the invention.

What is claimed is:

1. A golf game, comprising:

a plurality of different predetermined par values for representing different golf holes to be played;

a multiplicity of dice corresponding in number to a predetermined par value of a golf hole to be played, said dice each having six sides with at least two different representations on separate sides thereof;

a first chart representing possible tee shots for the golf holes to be played, wherein said first chart having said different predetermined par values, each par value on said first chart having all of the possible roll combinations for a first roll of a predetermined number of dice, said predetermined number of dice to be rolled corresponding to the par value of the golf hole being played, and each par value on said first chart having indicia corresponding to each different roll combination for determining the advancement of a ball on each hole;

a second chart representing possible approach shots from the fairway for the golf hole to be played which identifies all of the possible roll combinations of a subsequent roll of a predetermined subset of said dice and having indicia corresponding to each different roll combination dice for determining the advancement of a ball on each hole; and a third chart representing putt shots on the green of the hole to be played which identifies all of the possible roll combinations for a last roll of one die and having indicia corresponding to each different roll combination of said die for determining the number of putts of the ball to finish each hole.

2. The golf game according to claim 1, wherein said game includes five dice, each of said dice having six sides with three sides having a first representation thereon, two sides having a second representation different from said first and one side having a third representation different from said first and said second sides.

3. The golf game according to claim 2, wherein said first side of said dice is a representation of a golf ball, said second side is a blank face, and said third side is a representation of a sand trap.

4. The golf game according to claim 1, wherein five of said dice represent a driver, four of said dice represent a wood, three of said dice represent an iron, two of said dice represent a wedge and one of said die represents a putter and wherein said first chart includes tee shots for a driver, a wood and an iron, and said second chart includes approach shots for a wood, an iron, and a wedge.

5. The golf game according to claim 4, further including a score card having a first row with indicia thereon for identifying the par value for each hole to be played and which has additional rows underneath said first row for entering the scores for each player.

6. A method of playing a golf game comprising the steps of:

providing a plurality of different predetermined par values for representing different golf holes to be played;

providing a multiplicity of dice corresponding in number to a predetermined par value of a golf hole to be played, said dice each having six sides with at least two different representtions on separate sides thereof;

determining a par value for a hole to be played;

rolling a number of dice corresponding in number to the par value of the hole being played and which roll also represents a tee shot to produce a first roll combination; and comparing said first roll combination to a first chart, representing possible tee shots for the golf holes to be played, wherein said first chart having said different predetrmined par vlaues, each par value on said first chart having all of the possible roll combinations for a first roll of a predetermined number of dice, said predetrmined number of dice to be rolled corresponding to the par value of the golf hole being played, and each par value on said first chart having indicia corresponding to each different roll combination for determining at least the first of a number of strokes for completing said hole and the advancement of a ball on said hole.

7. The method of claim 6, further including the steps of:

rolling a lesser number of dice than said first roll which represents an approach shot to produce a second roll combination for further advancement of the ball; and comparing said second roll combination to a second chart representing possible approach shots for the golf hole to be played which identifies all of the possible roll combinations for a subsequent roll of said dice and having indicia corresponding to each different roll combination for determining at least the second of a number of strokes for completing said hole and a further advancement of a ball on said hole.

8. The method of claim 7, further including the steps of rolling one die which represents a putt; and comparing the representation of said die to a third chart representing possible putt shots for the golf hole to be played which identifies all of the possible roll combinations for the last roll of said dice and having indicia corresponding to each different roll combination for determining the final number of strokes for said hole.

9. The method of claim 8, additionally including the step of totaling the number of strokes for each player for each hole played and entering the same in a golf score card.

* * * * *